US009554616B2

(12) United States Patent
Horesh et al.

(10) Patent No.: US 9,554,616 B2
(45) Date of Patent: Jan. 31, 2017

(54) DUAL-DENSITY INSOLE WITH A MOLDED GEOMETRY

(75) Inventors: Haim Horesh, Ho Chi Minh (VN); Risha Kelley, Tigard, OR (US); Eugene LeSieur, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 199 days.

(21) Appl. No.: 13/283,266

(22) Filed: Oct. 27, 2011

(65) Prior Publication Data

US 2013/0104419 A1 May 2, 2013

(51) Int. Cl.

| | |
|---|---|
| ***A43B 7/14*** | (2006.01) |
| ***A43B 17/00*** | (2006.01) |
| ***A43B 17/02*** | (2006.01) |
| ***A43B 17/14*** | (2006.01) |

(52) U.S. Cl.

CPC ..... *A43B 7/1425* (2013.01); *A43B 7/144* (2013.01); *A43B 7/145* (2013.01); *A43B 7/146* (2013.01); *A43B 7/148* (2013.01); *A43B 7/149* (2013.01); *A43B 7/1465* (2013.01); *A43B 17/006* (2013.01); *A43B 17/02* (2013.01); *A43B 17/14* (2013.01)

(58) Field of Classification Search

CPC ..... A43B 7/1425; A43B 7/1465; A43B 7/145; A43B 7/149; A43B 7/146; A43B 7/148; A43B 17/02; A43B 17/006; A43B 17/14; A43B 17/148; A43B 13/203

USPC ..... 36/43, 44, 103, 30 R, 31, 141, 28, 29,36/25 R, 71

See application file for complete search history.

(56) References Cited

U.S. PATENT DOCUMENTS

| | | | | |
|---|---|---|---|---|
| 2,502,774 | A | 4/1950 | Alianiello | |
| 4,112,599 | A * | 9/1978 | Krippelz | 36/11.5 |
| 4,557,060 | A | 12/1985 | Kawashima | |
| 4,782,603 | A * | 11/1988 | Brown | 36/29 |
| 4,852,274 | A * | 8/1989 | Wilson | 36/29 |
| 4,999,931 | A * | 3/1991 | Vermeulen | 36/29 |
| 5,146,698 | A | 9/1992 | Tilles et al. | |
| 5,233,767 | A * | 8/1993 | Kramer | 36/28 |
| 5,367,791 | A * | 11/1994 | Gross et al. | 36/31 |
| 5,493,791 | A * | 2/1996 | Kramer | 36/28 |
| 5,619,809 | A * | 4/1997 | Sessa | 36/3 R |
| 5,685,094 | A | 11/1997 | Lin | |
| 6,314,584 | B1 * | 11/2001 | Errera | 2/239 |
| D572,887 | S | 7/2008 | Byrne et al. | |

(Continued)

FOREIGN PATENT DOCUMENTS

| | | |
|---|---|---|
| CA | 1 239 017 A1 | 7/1988 |
| CN | 1053884 | 8/1991 |

(Continued)

OTHER PUBLICATIONS

International Search Report and Written Opinion mailed May 13, 2013 in International Application No. PCT/US2012/062030.

(Continued)

*Primary Examiner* — Jila M Mohandesi
*Assistant Examiner* — Katharine Gracz
(74) *Attorney, Agent, or Firm* — Banner & Witcoff, Ltd.

(57) ABSTRACT

A dual-density insole (or sock liner) for a shoe is disclosed. The insole includes a carrier with two cavities. Two inserts with a density or hardness level that is different from that of the carrier are positioned in the cavities for increased performance. The disclosed insole further exhibits a molded geometry marked with shaped protrusions.

22 Claims, 10 Drawing Sheets

(56) References Cited

U.S. PATENT DOCUMENTS

| | | | | |
|---|---|---|---|---|
| D576,780 | S | 9/2008 | Jolicoeur | |
| 2003/0056396 | A1* | 3/2003 | Murray et al. | 36/28 |
| 2005/0066544 | A1* | 3/2005 | Beak | A43B 17/18 36/43 |
| 2006/0123664 | A1 | 6/2006 | Boyd et al. | |
| 2006/0277788 | A1 | 12/2006 | Fujii | |
| 2007/0277401 | A1* | 12/2007 | Young-Chul | 36/30 R |
| 2008/0005928 | A1* | 1/2008 | Koszegi | 36/29 |
| 2010/0037482 | A1* | 2/2010 | Litchfield et al. | 36/29 |
| 2010/0043252 | A1 | 2/2010 | Losio | |
| 2010/0170111 | A1 | 7/2010 | Kramer | |

FOREIGN PATENT DOCUMENTS

| | | | |
|---|---|---|---|
| CN | 1053884 | A | 8/1991 |
| CN | 1386052 | A | 12/2002 |
| CN | 101766367 | | 7/2010 |
| CN | 101766367 | A | 7/2010 |
| EP | 202713 | | 11/1986 |
| GB | 2011243 | | 7/1979 |
| GB | 2193426 | | 2/1988 |
| KR | 20100011003 | | 2/2010 |
| WO | 2008102391 | | 8/2008 |
| WO | 2013/063341 | A2 | 5/2013 |

OTHER PUBLICATIONS

Voluntary Amendments filed Aug. 19, 2014 in Chinese Patent Application No. 2012800525282.

Voluntary Amendments filed Nov. 11, 2014 in European Patent Application No. 12805804.7.

International Preliminary Report on Patentability (IPER) mailed May 8, 2014 for PCT/US2012/062030.

Chinese Office Action dated Mar. 31, 2015 in Chinese Patent Application No. 201280052528.2.

Response to Office Action for Chinese Patent Application No. 201280052528.2 as filed Feb. 25, 2016 and the English translation thereof.

Response to Office Action filed Aug. 17, 2015 in Chinese Patent Application No. 201280052528.2.

The Second Office Action for Chinese Application No. CN2012800525282, mailed on Dec. 10, 2015, 18 pages.

Response to Office Action filed Feb. 25, 2016, for Chinese Utility Patent Application No. 201280052528.2, 19pp.

* cited by examiner

DUAL-DENSITY INSOLE WITH A MOLDED GEOMETRY

BACKGROUND

The present disclosure relates generally to a dual-density insole (or sock liner) with a molded geometry for an article of footwear.

Most articles of footwear comprise both an upper piece and a sole. The upper is generally designed to enclose a wearer's foot, and in some circumstances to provide support for the foot during motion. The sole is generally designed to provide traction, protection, and also to support the foot. Typically, an article of footwear also includes an insole placed within the upper between the wearer's foot and the sole to provide additional comfort as well as increased performance for various activities.

SUMMARY

In one aspect, an insole for an article of footwear includes a carrier with a top surface and a bottom surface. The top surface of the carrier includes a first cavity. The insole further includes a first insert with a top surface and a bottom surface. The first insert is configured to fit within the first cavity, and the bottom surface of the first insert is configured to mate with a surface of the first cavity. Still further, the top surface of the carrier and the top surface of the first insert include a plurality of protrusions.

In another aspect, an insole for placement in an article of footwear comprises a carrier having a top surface and a bottom surface. The top surface includes a first cavity at a forefoot end and a second cavity at a heel end, and the carrier is comprised of a material having a first hardness level. The insole also includes a first insert having a top surface and a bottom surface, the first insert being configured to fit within the first cavity, and the bottom surface of the first insert configured to mate with a surface of the first cavity. Further, the first insert is comprised of a material having a second hardness level. The insole further includes a second insert having a top surface and a bottom surface, the second insert being configured to fit within the second cavity, and the bottom surface of the second insert configured to mate with a surface of the second cavity. Further, the second insert is also comprised of a material having a third second hardness level. According to the disclosure, the second hardness level is higher than the first hardness level. Additionally, the top surface of the carrier, the top surface of the first insert and the top surface of the second insert include a plurality of protrusions.

In still another aspect, an insole for an article of footwear includes a carrier configured to receive a first insert at a forefront end and a second insert at a heel end. The first insert spans a portion of the insole interacting with a wearer's forefoot. The second insert spans a portion of the insole interacting with a wearer's heel. Additionally, a top surface of the carrier, a top surface of the first insert and a top surface of the second insert include protrusions.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles described herein. Moreover, in the figures, like reference numerals designate corresponding parts throughout the different views.

DETAILED DESCRIPTION

Figure 1:
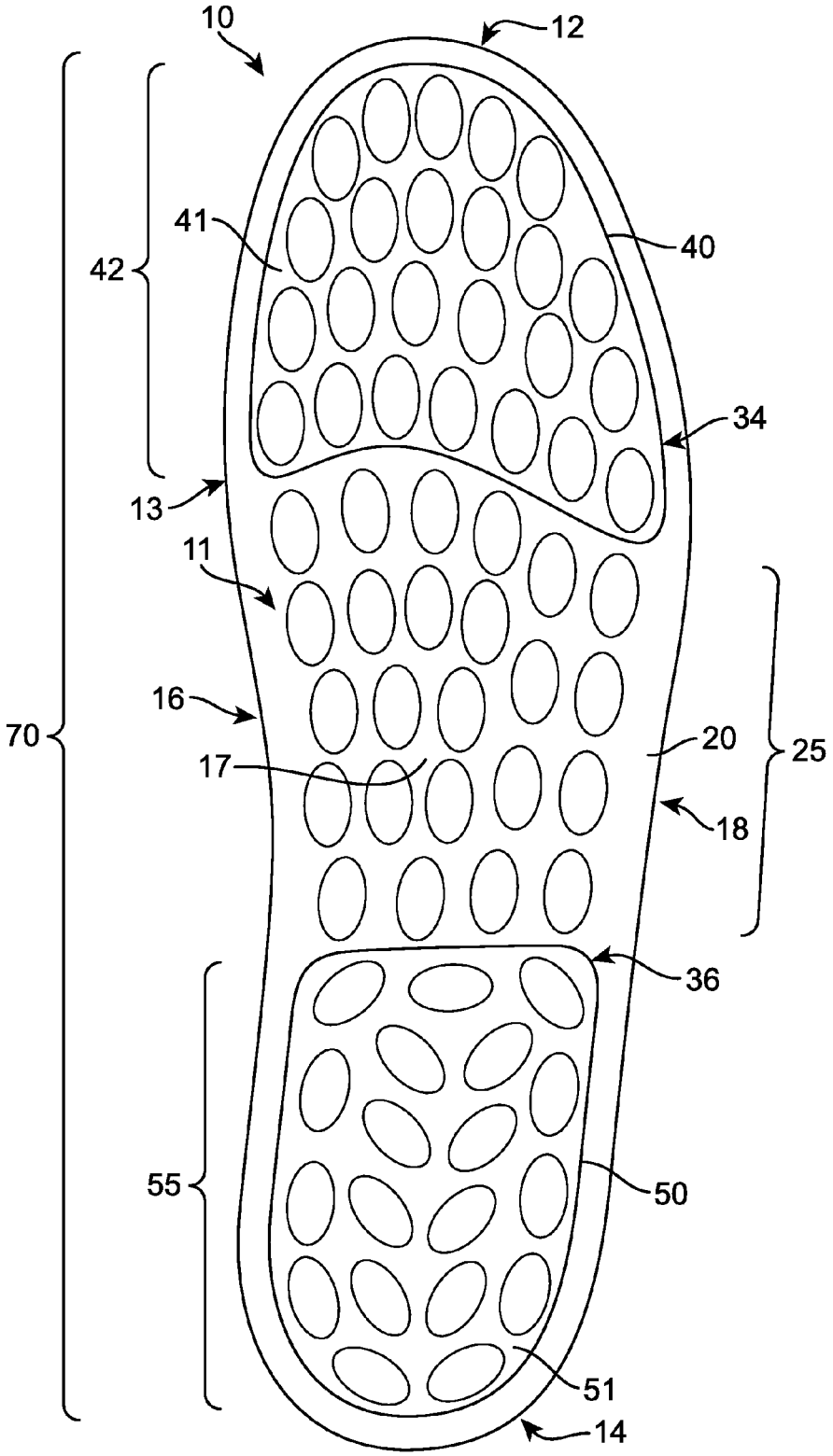
FIG. 1 is a top view of an embodiment of a dual-density insole.
Figure 4:
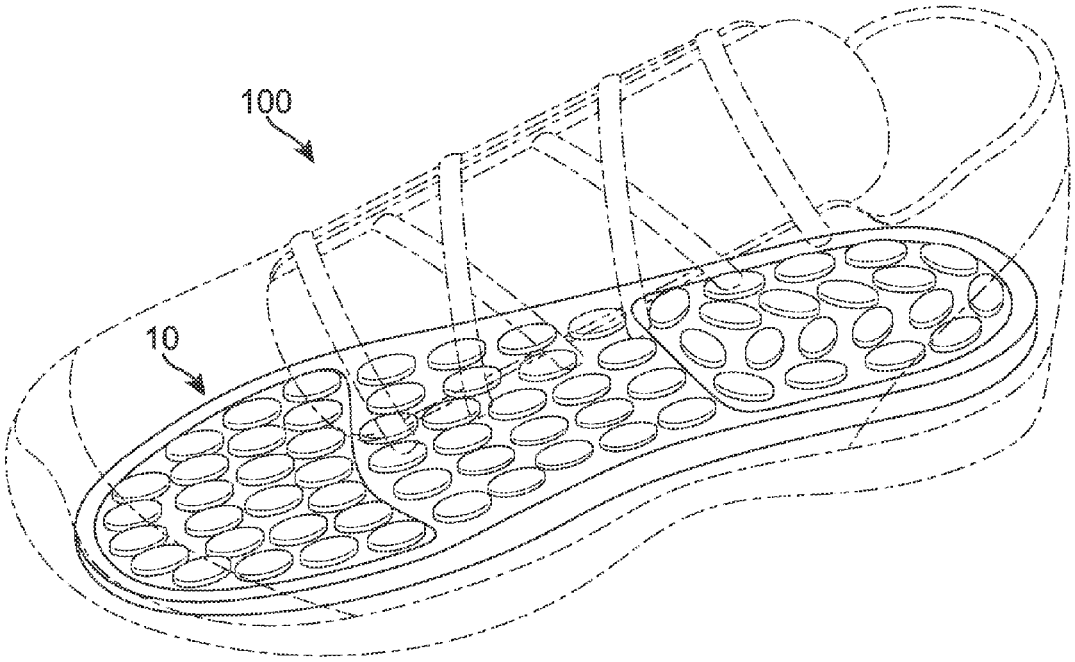
FIG. 4 is a side perspective view of an embodiment of a dual-density insole shown within an article of footwear.

FIG. 1 is a top plan view of a dual-density insole 10 (or sock liner) according to at least one embodiment described herein. Insole 10 may be adapted for placement in any kind of footwear, including, but not limited to: running shoes, hiking boots, soccer shoes, football shoes, sneakers, rugby shoes, basketball shoes, baseball shoes as well as other kinds of shoes. Insoles associated with the present embodiments may also be adapted for placement in any non-athletic shoe, including, but not limited to: dress shoes, loafers, sandals, and boots. FIG. 4 depicts placement of insole 10 in exemplary footwear 100, according to aspects described herein, however, an individual skilled in the relevant art will appreciate that the concepts disclosed herein apply for use with a wide variety of footwear styles, in addition to the specific style discussed in the following material and depicted in the accompanying figures.

Referring to FIG. 1, for purposes of reference, insole 10 may be divided into various portions including forefoot portion 12, midfoot portion 17 and heel portion 14. It will be understood that forefoot portion 10, midfoot portion 17 and heel portion 14 are only intended for purposes of description and are not intended to demarcate precise regions, but rather relative locations of insole 10. Additionally, for purposes of reference, insole 10 may be divided into a medial side 16 and a lateral side 18. It will be understood that medial side 16 and lateral side 18 are only intended for purposes of description and are not intended to precisely divide insole 10 into two regions.

Insole 10 may include provisions for improving support for a foot placed within an article. In some cases, insole 10 may comprise a dual-density design that provides differential support along the foot. These provisions may include features such as a molded geometry and dual-density design for added support and improved performance, as well as for deflection of moisture. These and other features of certain embodiments of insole 10 are discussed in more detail below.

Figure 2:
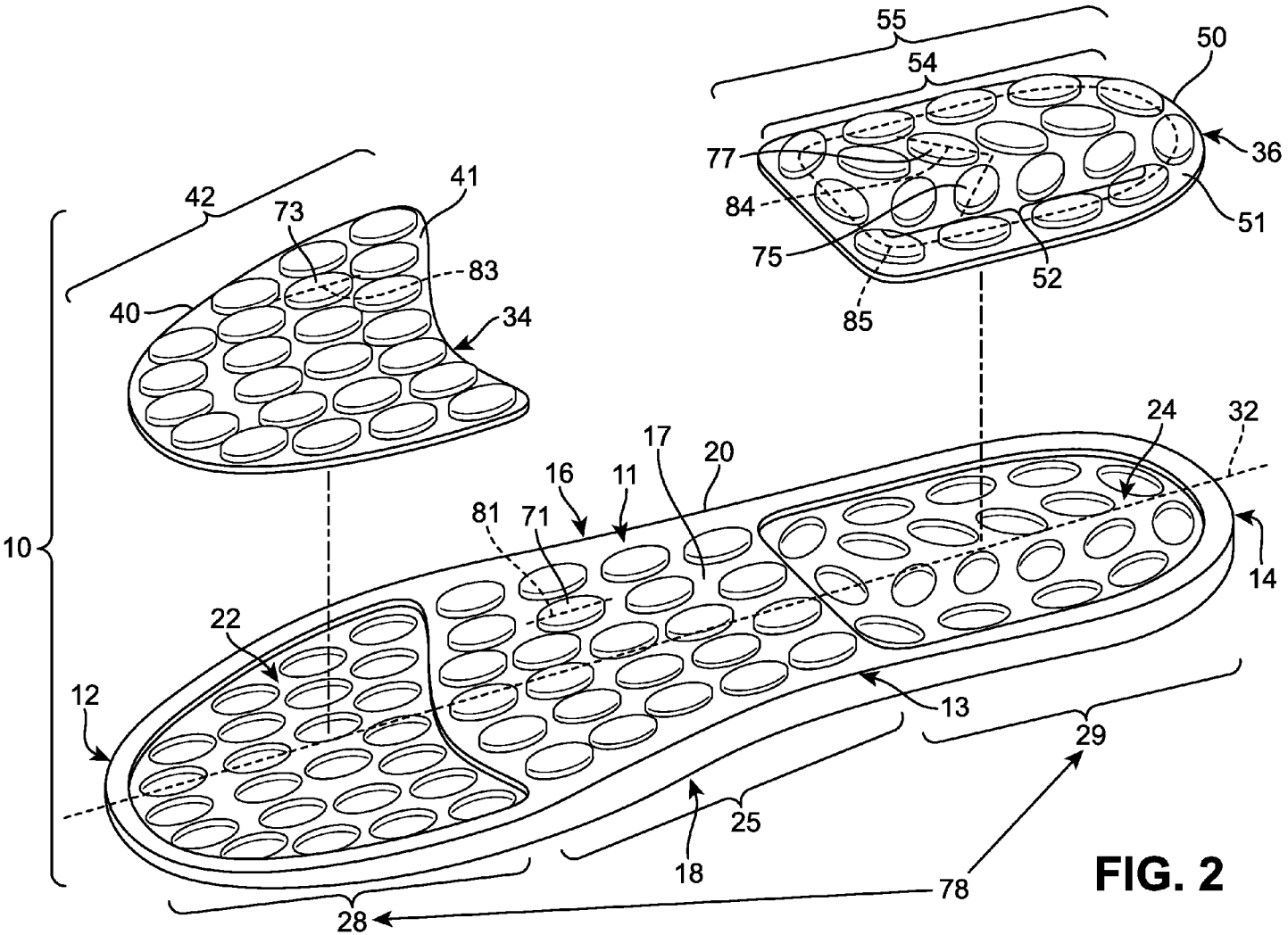
FIG. 2 is an exploded perspective view of an embodiment of a dual-density insole.

As seen in FIGS. 1-2, in some embodiments, insole 10 exhibits a partially layered structure. In some cases, insole 10 can include carrier 20. In some cases, insole 10 may also include one or more inserts. For example, the illustrated embodiment includes first insert 40 and second insert 50. However, other embodiments could include any other number of inserts.

In some embodiments, carrier 20 may have the overall shape and dimensions of a traditional footbed. This overall shape for carrier 20 may allow insole 10 to be placed into the footbed of an article of footwear, as seen in exemplary footwear 100 of FIG. 4. Moreover, in some embodiments, carrier 20 may be shaped in a manner so that first insert 40 and second insert 50 may be incorporated into insole 10. In some cases, carrier 20 includes at least one cavity. In some cases, carrier 20 can include two or more cavities. In at least one embodiment, carrier 20 can include two cavities, such as a first cavity 22 and a second cavity 24, as seen in FIG. 2.

In different embodiments, the locations of one or more cavities could vary. In some cases, first cavity 22 and/or second cavity 24 could be disposed on a top surface 11 of carrier 20. In other cases, first cavity 22 and/or second cavity 24 could be disposed on a lower surface (not shown) of carrier 20. In one embodiment, first cavity 22 and second cavity 24 may both be disposed on top surface 11 of carrier 20. Moreover, in some cases each cavity could be disposed at different locations along the length of carrier 20. In some cases, one or more cavities could be disposed in forefoot portion 12 of carrier 20. In other cases, one or more cavities could be disposed in heel portion 14 of carrier 20. In still other cases, one or more cavities could be disposed in midfoot portion 17 of carrier 20. In one embodiment, first cavity 22 may be disposed in forefoot portion 12 and second cavity 24 may be disposed in heel portion 14.

According to at least one embodiment, first cavity 22 and second cavity 24 may be positioned inwardly from a perimeter 13 of the insole 10. In other cases, however, first cavity 22 and/or second cavity 24 may not be disposed inwardly of perimeter 13. For example, in some cases, a portion of first cavity 22 and/or second cavity 24 may extend all the way to perimeter 13 of insole 10.

In different embodiments, the size of one or more cavities could vary. In particular, the approximate length and width of first cavity 22 and second cavity 24 could be varied in any manner. In addition, the depth of each cavity could be varied in any manner. For example, the depth of each recess could be selected in order to accommodate an insert of a predetermined thickness.

In different embodiments, the shape of each cavity could be varied in any manner. Although the current embodiment illustrates cavities having a particular perimeter shape, other embodiments could include cavities with different perimeter shapes. For example, in some other embodiments, the perimeter shape of first cavity 22 and/or second cavity 24 could be associated with any shape including, but not limited to: rounded shapes, circular shapes, triangular shapes, rectangular shapes, polygonal shapes, regular shapes or irregular shapes, as well as any other shapes.

Insole 10 may include provisions for increased performance, to facilitate comfort and, in some cases, provide moisture control. In some embodiments, insole 10 could include one or more protrusions. In some cases, carrier 20 may include one or more protrusions. In some cases, first insert 40 and/or second insert 50 could include one or more protrusions. In one embodiment, first insert 40 and/or second insert 50 could include protrusions that cooperate with protrusions of carrier 20 in order to provide enhanced comfort for a user.

In some embodiments, insole 10 may include a plurality of protrusions 70 on a top surface 11. In some cases, plurality of protrusions 70 may be disposed in a forefoot portion 12. In other cases, plurality of protrusions 70 may be a disposed in a heel portion 14. In still other cases, plurality of protrusions 70 may be disposed in a midfoot portion 17. In one embodiment, plurality of protrusions 70 may be disposed in forefoot portion 12, midfoot portion 17 and heel portion 14.

In different embodiments, the number of protrusions disposed on insole 10 may vary. According to a current embodiment described herein, plurality of protrusions 70 may comprise 24 protrusions in a forefoot portion 12, 24 protrusions in a midfoot portion 17 and 19 protrusions in a heel portion 14. In other cases, however, the number of plurality of protrusions 70 may be more or less than depicted in the figures. In still other cases, protrusions may be present in some portions of insole 10 but not in other portions.

In different embodiments, protrusions may take on a variety of shapes and sizes. For example, in some cases, protrusions may be approximately oval-shaped. In other cases, protrusions may be circular and take on the appearance of a partial sphere protruding above a top surface 11. In still other cases, protrusions could have any other shapes including, but not limited to: rounded shapes, circular shapes, triangular shapes, rectangular shapes, polygonal shapes, regular shapes, irregular shapes as well as any other kinds of shapes. In one embodiment, plurality of protrusions 70 may be associated with an approximately oval-like shape. Moreover, the current embodiment illustrates protrusions having an approximately rounded or concave upper surface. However, in other embodiments, one or more protrusions could have an approximately convex upper surface. In still other embodiments, one or more protrusions could have an approximately flat upper surface.

Protrusions on insole 10 may also be oriented in a number of ways to achieve enhanced performance properties. In some embodiments, the protrusions may be oriented along various contours of insole 10. For example, in some embodiments, plurality of protrusions 70 may be oriented along perimeter 13. In other embodiments, the orientation of different protrusions may vary throughout different portions of insole 10. For example, in some cases, groups of protrusions disposed in forefoot portion 12, midfoot portion 17 and heel portion 14 could each have substantially different orientations.

For purposes of reference, plurality of protrusions 70 may be divided into subsets or groups. In one embodiment, as illustrated in FIGS. 1-2, plurality of protrusions 70 may be divided into upper forefoot protrusions 42, midfoot protrusions 25 and upper heel protrusions 55 associated with forefoot portion 12, midfoot portion 17 and heel portion 14, respectively. Moreover, some protrusions may be disposed on carrier 20, while other protrusions may be disposed on first insert 40 and second insert 50. In the current embodiment, upper forefoot protrusions 42 may be disposed on first insert 40. Also, midfoot protrusions 25 may be disposed on carrier 20. In addition, upper heel protrusions 55 may be disposed on second insert 50. In other embodiments, however, some groups of protrusions could be disposed on carrier 20 as well as first insert 40 and/or second insert 50.

Figure 3:
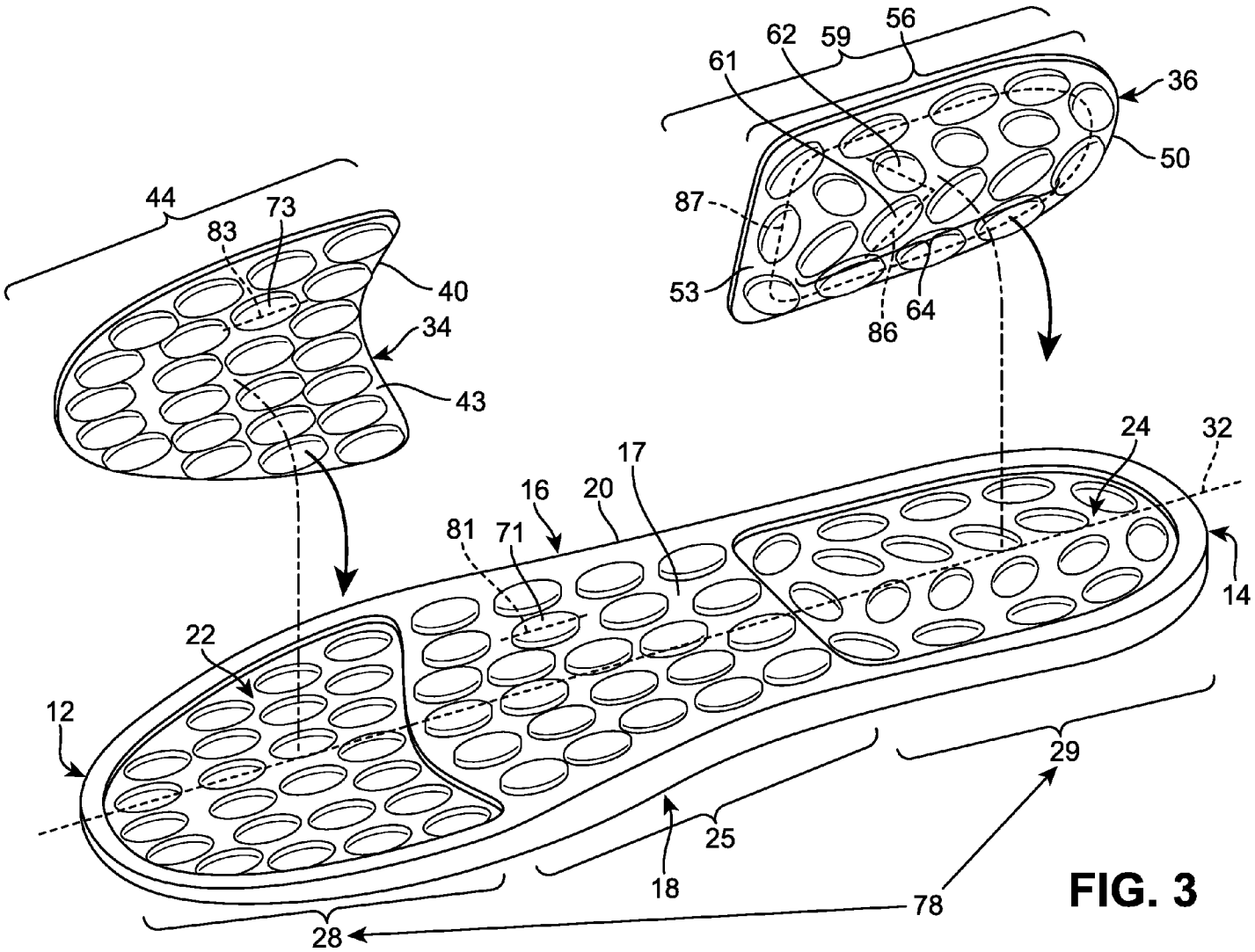
FIG. 3 is another exploded perspective view of an embodiment of a dual-density insole, wherein portions of the insole have been rotated.

The arrangement of protrusions on different portions of insole 10 is best illustrated in FIGS. 2 and 3. Referring first to the protrusions on carrier 20, midfoot protrusions 25 may comprise an arrangement of protrusions extending approximately between first insert 40 and second insert 50. In some cases, midfoot protrusions 25 may be oriented along an approximately longitudinal direction of insole 10. In other words, the length of each protrusion of midfoot protrusions 25 may be aligned in an approximately longitudinal direction. As an example, illustrated in FIGS. 2 and 3, protrusion 71 of midfoot protrusions 25 has a centerline 81 that is approximately parallel with centerline 32 of insole 10. In other embodiments, however, midfoot protrusions 25 could be oriented in any other manner. For example, in another embodiment, midfoot protrusions could be arranged such that a centerline of each protrusion is approximately parallel with a lateral direction of insole 10.

Referring next to the protrusions in the forefoot area 12 of insole 10, forefoot protrusions may comprise an arrangement of upper forefoot protrusions 42 extending on an upper surface 41 of first insert 40. In some cases upper forefoot protrusions 42 may be oriented along an approximately longitudinal direction of insole 10, similar to midfoot protrusions 25. In other words, the length of each protrusion of upper forefoot protrusions 42 may be aligned in an approximately longitudinal direction. As an example, illustrated in FIG. 2, protrusion 73 of upper forefoot protrusions 42 has a centerline 83 that is approximately parallel with centerline 32 of insole 10. In other embodiments, however, upper forefoot protrusions 42 could be oriented in any other manner. For example, in still another embodiment, upper forefoot protrusions 42 could be arranged such that a centerline of each protrusion is approximately parallel with a perimeter 34 of first insert 40. In other embodiments, upper forefoot protrusions 42 could be arranged in an approximately lateral direction of insole 10. In still other embodiments, upper forefoot protrusions 42 could be absent altogether.

In some cases, first insert 40 may comprise an arrangement of lower forefoot protrusions 44 extending on a lower surface 43 of first insert 40. In some cases lower forefoot protrusions 44 may be a mirror image of upper forefoot protrusions 42, i.e. oriented along an approximately longitudinal direction of insole 10. In other words, the length of each protrusion of lower forefoot protrusions 44 may be aligned in an approximately longitudinal direction. As an example, illustrated in FIG. 3, protrusion 73 of lower forefoot protrusions 44 has a centerline 83 that is approximately parallel with centerline 32 of insole 10. In other embodiments, however, lower forefoot protrusions 44 could be oriented in any other manner. For example, in still another embodiment, lower forefoot protrusions 44 could be arranged such that a centerline of each protrusion is approximately parallel with a perimeter 34 of first insert 40. In other embodiments, lower forefoot protrusions 44 could be arranged in an approximately lateral direction of insole 10. In still other embodiments, lower forefoot protrusions 44 could be absent altogether.

Referring next to the protrusions in the heel area 14 of insole 10, heel protrusions may comprise an arrangement of upper heel protrusions 55 extending on an upper surface 51 of second insert 50. In some cases upper heel protrusions 55 may be comprised of an interior set of protrusions, collectively, interior protrusions 52, and an exterior set of protrusions, collectively, exterior protrusions 54. In some cases, interior protrusions 52 may be arranged in corresponding pairs. Each pair may be oriented so that the forward ends of the protrusions are spaced further apart from the rearward end of the protrusions. In some cases, interior protrusions 52 may be oriented such that the protrusions form multiple V-like shapes down the center line 32, oriented towards the forefoot end 12. As an example, illustrated in FIG. 2, protrusion 75 and protrusion 77 of upper heel protrusions 55 are oriented in an approximately V-like shape 84 that is approximately aligned with centerline 32 of insole 10.

In some cases, exterior protrusions 54 may be patterned around a perimeter edge 36 of second insert 50. In at least one embodiment, protrusions 54 may be generally oriented end to end around outer perimeter 36 of second insert 50 in a circumferential pattern 85. In other embodiments, however, upper heel protrusions 55 could be oriented in any other manner. For example, in still another embodiment, upper heel protrusions 55 could be arranged in an approximately lateral direction of insole 10. In another embodiment, upper heel protrusions 55 could be arranged in alternative patterns, such as u-shaped groups. In still other embodiments, upper forefoot protrusions 55 could be absent altogether.

In some cases, second insert 50 may comprise an arrangement of lower heel protrusions 59 extending on a lower surface 53 of second insert 50. In some cases lower heel protrusions 59 may be a mirror image of upper heel protrusions 55, i.e. comprised of an interior set of protrusions, collectively, interior protrusions 64, and an exterior set of protrusions, collectively, exterior protrusions 56. In at least one embodiment, interior protrusions 64 may be oriented such that the protrusions form multiple V-like shapes down a longitudinal center line 32, oriented towards the forefoot end 12. As an example, illustrated in FIG. 3, lower heel protrusion 61 and protrusion 62 are oriented in an approximately V-like shape 86 that is approximately aligned with centerline 32 of insole 10.

In some cases, lower heel exterior protrusions 56 may be patterned around a perimeter edge 36 of second insert 50. In at least one embodiment, protrusions 56 may be generally oriented end to end around outer perimeter 36 of second insert 50 in a circumferential pattern 87. In other embodiments, however, lower heel protrusions 59 could be oriented in any other manner. For example, in still another embodiment, lower heel protrusions 59 could be arranged in an approximately lateral direction of insole 10. In another embodiment, lower heel protrusions 59 could be arranged in alternative patterns, such as u-shaped groups. In still other embodiments, lower heel protrusions 59 could be absent altogether.

First cavity 22 and second cavity 24 of carrier 20 may also include a molded geometry that is configured to mate with first insert 40 and second insert 50. In some cases, first cavity 22 and second cavity 24 may include a plurality of indentations generally covering the entire space of first cavity 22 and second cavity 24. In other cases, the indentations may be limited to partial areas of first cavity 22 and second cavity 24. In some embodiments, carrier 20 includes plurality of indentations 78. In some cases, plurality of indentations 78 may further comprise forefoot indentations 28 that are disposed in first cavity 22. In at least one embodiment, forefoot indentations 28 are sized and configured to receive lower forefoot protrusions 44 of first insert 40. For example, in one embodiment, each indentation of forefoot indentations 28 has an approximately oval-like shape for receiving a corresponding protrusion of lower forefoot protrusions 44. Moreover, the number and arrangement of forefoot indentations 28 within first cavity 22 may match the approximate arrangement of lower forefoot protrusions 44 of first insert 40. This configuration allows lower forefoot protrusions 44 of first insert 40 to mate with forefoot indentations 28 of first cavity 22, which can help to enhance stability for insole 10.

It should be understood that one or more properties of forefoot indentations 28 could be varied in other embodiments. For example, in some cases, forefoot indentations 28 could have any other shape including any of the shapes described above for lower forefoot protrusions 44. Additionally, in some cases, forefoot indentations 28 could be arranged in any other manner. In still other cases, the number of forefoot indentations 28 could be varied. In still other cases, forefoot indentations 28 could be absent altogether. For example, in some cases, underside 43 of first insert 40 could be configured to mate with first cavity 22 in a way that facilitates the attachment of first insert 40 to carrier 20, as would be contemplated by a skilled artisan.

In some cases, plurality of indentations 78 may further comprise heel indentations 29 that are disposed in second cavity 24. In at least one embodiment, heel indentations 29 are sized and configured to receive lower heel protrusions 59 of second insert 50. For example, in one embodiment, each indentation of heel indentations 29 has an approximately oval-like shape for receiving a corresponding protrusion of lower heel protrusions 59. Moreover, the number and arrangement of heel indentations 29 within second cavity 24 may match the approximate arrangement of lower heel protrusions 59 of second insert 50. This configuration allows lower heel protrusions 59 of second insert 50 to mate with heel indentations 29 of second cavity 24, which can help to enhance stability for insole 10.

It should be understood that one or more properties of heel indentations 29 could also be varied in other embodiments. For example, in some cases, heel indentations 29 could have any other shape including any of the shapes described above for lower heel protrusions 59. Additionally, in some cases, heel indentations 29 could be arranged in any other manner. In still other cases, the number of heel indentations 29 could be varied. In still other cases, heel indentations 29 could be absent altogether. For example, underside 53 of second insert 50 could be configured to mate with second cavity 24 in a way that facilitates the attachment of second insert 50 to carrier 20, as would be contemplated by a skilled artisan.

First insert 40 and second insert 50 of insole 10 may each exhibit a certain thickness. In some cases, first insert 40 and second insert 50 may have a similar thickness. In other cases, the respective thicknesses may be different. Further, in some cases, lower forefoot protrusions 44 of first insert 40 and lower heel protrusions 59 of second insert 50 may extend all the way down into, and mate with forefoot indentations 28 and heel indentations 29, respectively. In other cases, lower forefoot protrusions 44 and lower heel protrusions 59 may not extend all the way down into forefoot indentations 28 and heel indentations 29. In the latter case, there may still be some fitting to facilitate attachment of first insert 40 and second insert 50 into first cavity 22 and second cavity 24, respectively.

Figure 5:
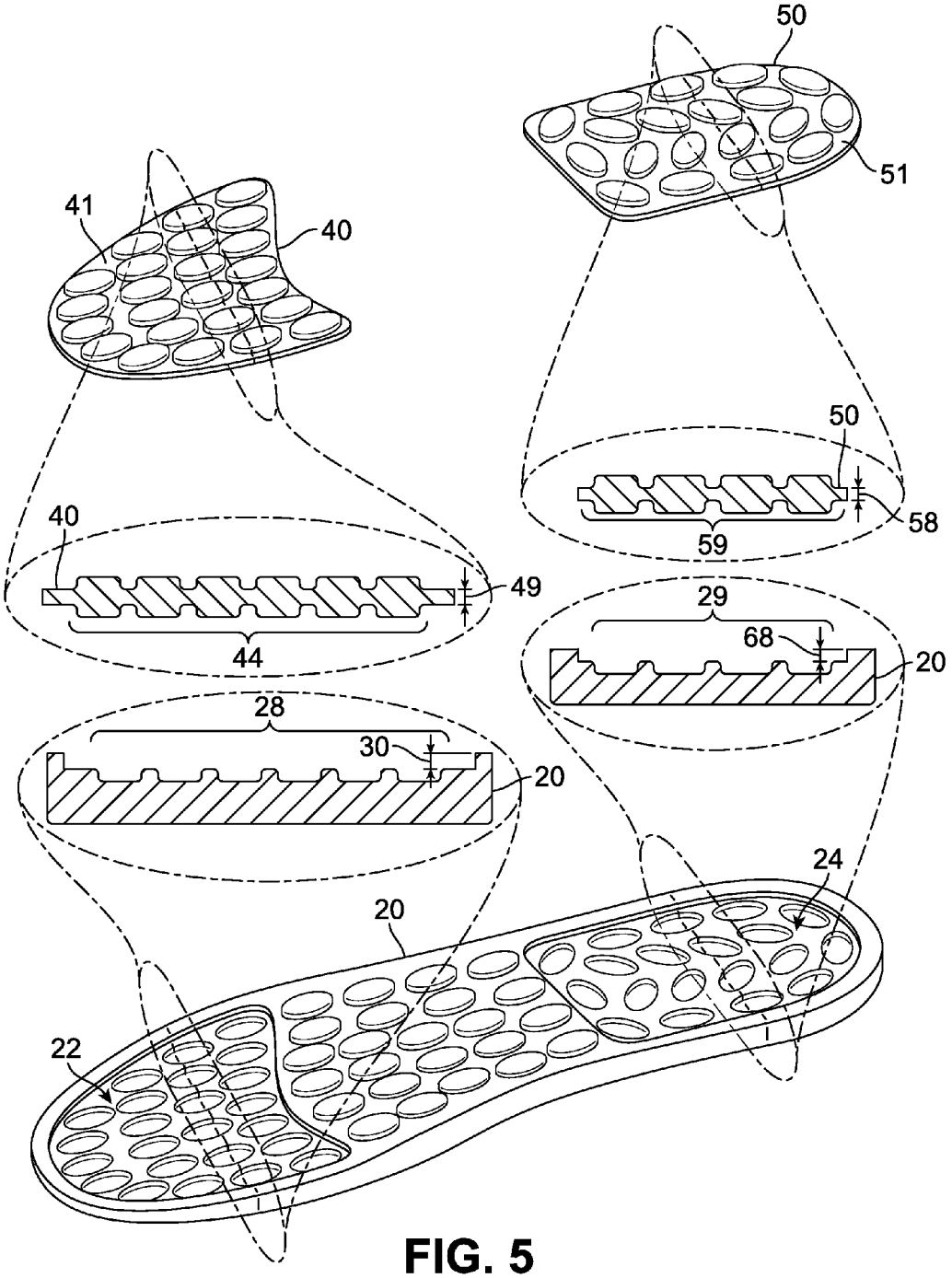
FIG. 5 is another exploded perspective view of an embodiment of a dual-density insole, wherein cross-sectional views of portions of the insole are shown.
Figure 6:
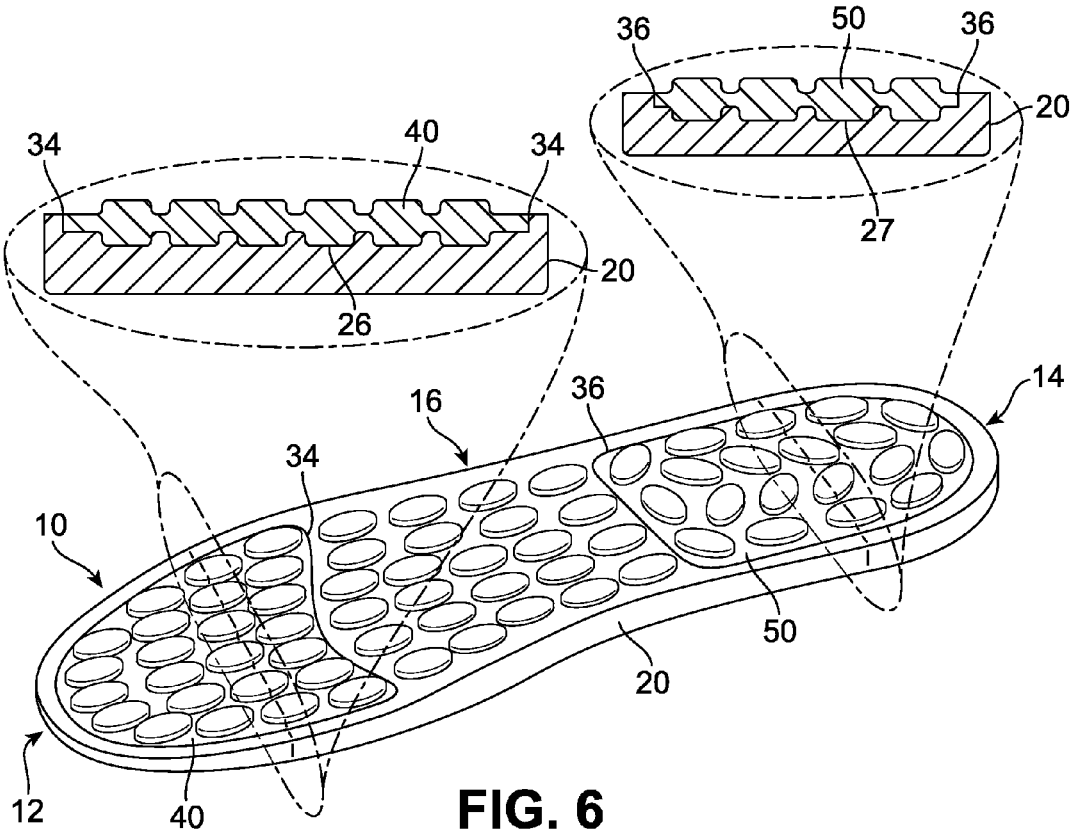
FIG. 6 is a perspective view of an embodiment of a dual-density insole, wherein cross-sectional views of the insole with inserts are shown.

FIGS. 5 and 6 illustrate cross sectional views of first insert, 40, second insert 50, first cavity 22 and second cavity 24, in order to illustrate the corresponding geometries of these components. Referring to FIGS. 5 and 6, according to at least one embodiment set forth herein, first insert 40 may exhibit a thickness 49, which may be approximately equal to a depth 30 of first cavity 22. Thus, in some cases, when placed within first cavity 22 such that lower forefoot protrusions 44 line up and mate with forefoot indentations 28 at boundary 26, the upper surface of first insert 40 and the upper surface of carrier 20 may be generally flush. Additionally, according to at least one embodiment, second insert 50 may exhibit a thickness 58, which may be approximately equal to a depth 68 of second cavity 24. Thus, in some cases, when placed within second cavity 24 such that lower heel protrusions 59 line up and mate with heel indentations 29 at boundary 27, the upper surface of second insert 50 and the upper surface of carrier 20 may also be generally flush.

According to aspects set forth herein, first insert 40 and second insert 50 may be sized and shaped to provide increased performance properties to a wearer's forefoot and heel areas. In particular, the area of first cavity 22 and respective first insert 40 may be sized to span at least a portion of insole 10. In some cases, the area of first cavity 22 and first insert 40 may be sized so that generally all portions of a wearer's forefoot strikes first insert 40 when the foot is in motion. Likewise, the area of second cavity 24 and respective second insert 50 may be sized to span at least of portion of insole 10. In some cases, the area of second cavity 24 and second insert 50 may be sized so that generally all portions of a wearer's heel strikes second insert 50 when the foot is in motion.

Figure 7:
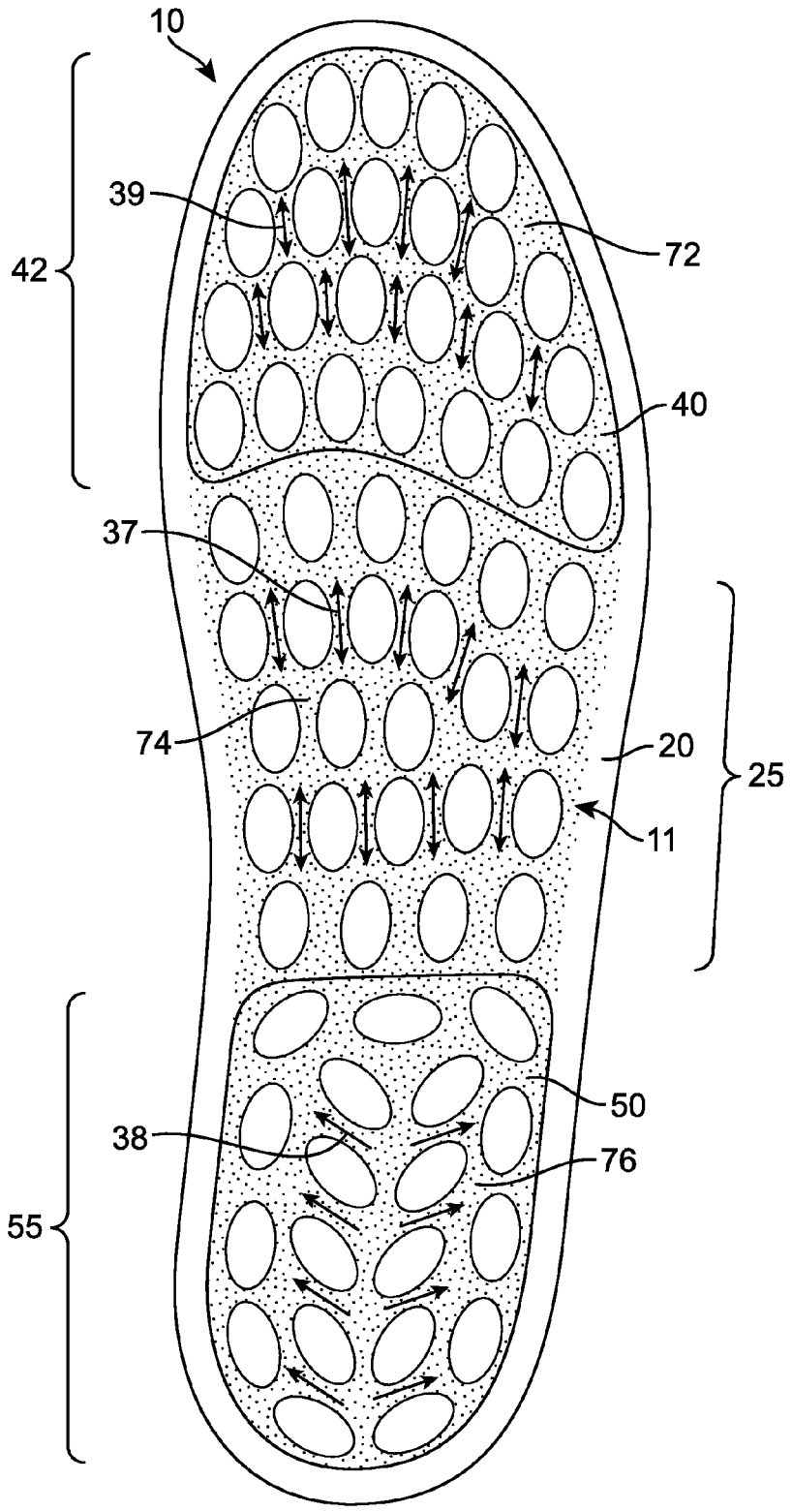
FIG. 7 is another top view of an embodiment of a dual-density insole, wherein exemplary moisture control flow arrows are shown.

Certain provisions of insole 10, in particular the molded geometry of carrier 20, first insert 40 and second insert 50, may provide additional comfort and support to a wearer's foot as well as help to control moisture within the shoe, facilitating performance. FIG. 7 depicts a top view of an embodiment of a dual-density insole 10 with arrows 37, arrows 38 and arrows 39 showing possible directions of moisture deflection. According to at least one embodiment, during normal wear, a wearer's foot may generally rest on midfoot protrusions 25, upper forefoot protrusions 42 and upper heel protrusions 55. In other words, in certain areas a wearer's foot may rest slightly above a top surface 11 of insole 10. During active wear, any moisture or perspiration that may be present may therefore tend to congregate and be siphoned in space 72, space 74 and space 76 (depicted as shaded areas). Space 72, space 74 and space 76 generally extend between upper forefoot protrusions 42, midfoot protrusions 25 and upper heel protrusions 55, respectively. For the wearer, this siphoning of moisture away from the foot may create better traction of the wearer's foot against insole 10, and thus, enhanced performance, as well as a more comfortable wearing experience.

Referring to various components of insole 10 shown in the figures, for example, in FIG. 6, insole 10 may include provisions for increased performance at a forefoot portion 12 and a heel portion 14. In some cases, insole 10 may be configured as a multi-density insole such that the density of insole 10 varies over different portions. In one embodiment, first insert 40 and second insert 50 may comprise materials of a substantially different density from the material of carrier 20.

According to at least one embodiment described herein, insole 10 may be constructed of materials selected for having properties to facilitate enhanced performance. For example, carrier 20, first insert 40 and second insert 50 of insole 10 may be made from a variety of materials in a variety of hardness levels to achieve desired performance characteristics. In some cases, carrier 20, first insert 40 and second insert 50 of insole 10 may all be made from a variety of polymer materials in a variety of hardness levels to achieve desired performance characteristics. Exemplary polymer materials may include, but are not limited to, poly-vinyl acetate or ethylene-vinyl acetate. However, those skilled in the art will readily acknowledge the full breadth of materials available for use beyond the exemplary ones specified, and that would still fall within the spirit and scope of the present disclosure.

Carrier 20, first insert 40 and second insert 50 may each be molded from their respective materials to achieve a desired shape, protrusion pattern, thickness, etc. In some cases, the components may each be separately molded, e.g., by compression molding, from materials exhibiting a different hardness or density. This configuration may help provide increased performance during use. Once molded, first insert 40 and second insert 50 may be secured in first cavity 22 and second cavity 24 of carrier 20, respectively, by means known to those skilled in the art. For example, one known means of securing such materials may involve use of a thermoplastic adhesive. Those skilled in the art will readily appreciate, however, the variety of ways in which carrier 20, first insert 40 and second insert 50 may be constructed. Moreover, those skilled in the art will readily appreciate the variety of ways that can be used for securing first insert 40 and second insert 50 within carrier 20.

As set forth herein, the components of insole 10 may be constructed of materials exhibiting different hardness levels to provide increased performance during wear. In some cases, first insert 40 and second insert 50 may be constructed of material having a higher hardness level than that of carrier 20. In such cases, the higher hardness level may allow first insert 40 and second insert 50 to exhibit improved shock absorption properties. Additionally, the higher hardness level may facilitate a better rebound when a wearer's foot, and specifically a wearer's forefoot and heel, exerts pressure on first insert 40 and second insert 50, respectively. In other cases, carrier 20 could be configured with a higher hardness level than first insert 40 and/or second insert 50. In such cases, the lower hardness level of first insert 40 and second insert 50 could enhance cushioning in the forefoot and/or heel.

According to aspects described herein, the hardness of the various components of insole 10 may be assessed using an Asker Type C durometer, as is well-known in the art. Specifically, a durometer measurement may be taken to measure an indentation hardness on the surface of each of carrier 20, first insert 40 and second insert 50. According to the present disclosure, the Asker Type C hardness level relationship between the components of insole 10 may be adjusted to achieve enhanced performance. For example, as set forth above, first insert 40 and second insert 50 may be comprised of a material exhibiting a higher Asker Type C hardness level than that of carrier 20.

According to features of the disclosure, carrier 20, first insert 40 and second insert 50 may be constructed from various different materials. In some cases, carrier 20, first insert 40 and second insert 50 may be constructed of the same material. In other cases, carrier 20 may be constructed of one material and first insert 40 and second insert 50 may be constructed of a different material. In still other cases, one of first insert 40 or second insert 50 may be made of a substantially similar material to carrier 20 and the remaining insert may be made of a different material. In at least one case, carrier 20, first insert 40 and second insert 50 may be constructed from poly-vinyl acetate. In another case, carrier 20 may be constructed of ethylene-vinyl acetate. It should be understood, however, that carrier 20, first insert 40 and second insert 50 may be constructed from a variety of materials known to a skilled artisan.

In addition, the hardness level of carrier 20, first insert 40 and second insert 50 may vary. In some cases, carrier 20, first insert 40 and second insert 50 may exhibit different hardness levels. In one case, carrier 20 may exhibit a first hardness level and first insert 40 and second insert 50 may exhibit a second, higher, hardness level. In another case, carrier 20 may exhibit a first hardness level, and first insert 40 and second insert 50 may exhibit a second, lower, hardness level. In still other cases, one of first insert 40 or second insert 50 may exhibit a hardness level that is substantially similar to the hardness level of carrier 20 and the remaining insert may exhibit a different hardness level. In at least one case, carrier 20 may exhibit a hardness level of approximately 35 Asker C Hardness and first insert 40 and second insert 50 may exhibit a hardness level of approximately 55 Asker C Hardness. Again, it will be understood by a skilled artisan that carrier 20, insert 40 and insert 50 may exhibit varying hardness levels and still fall within the spirit and scope of the present disclosure.

Figure 8:
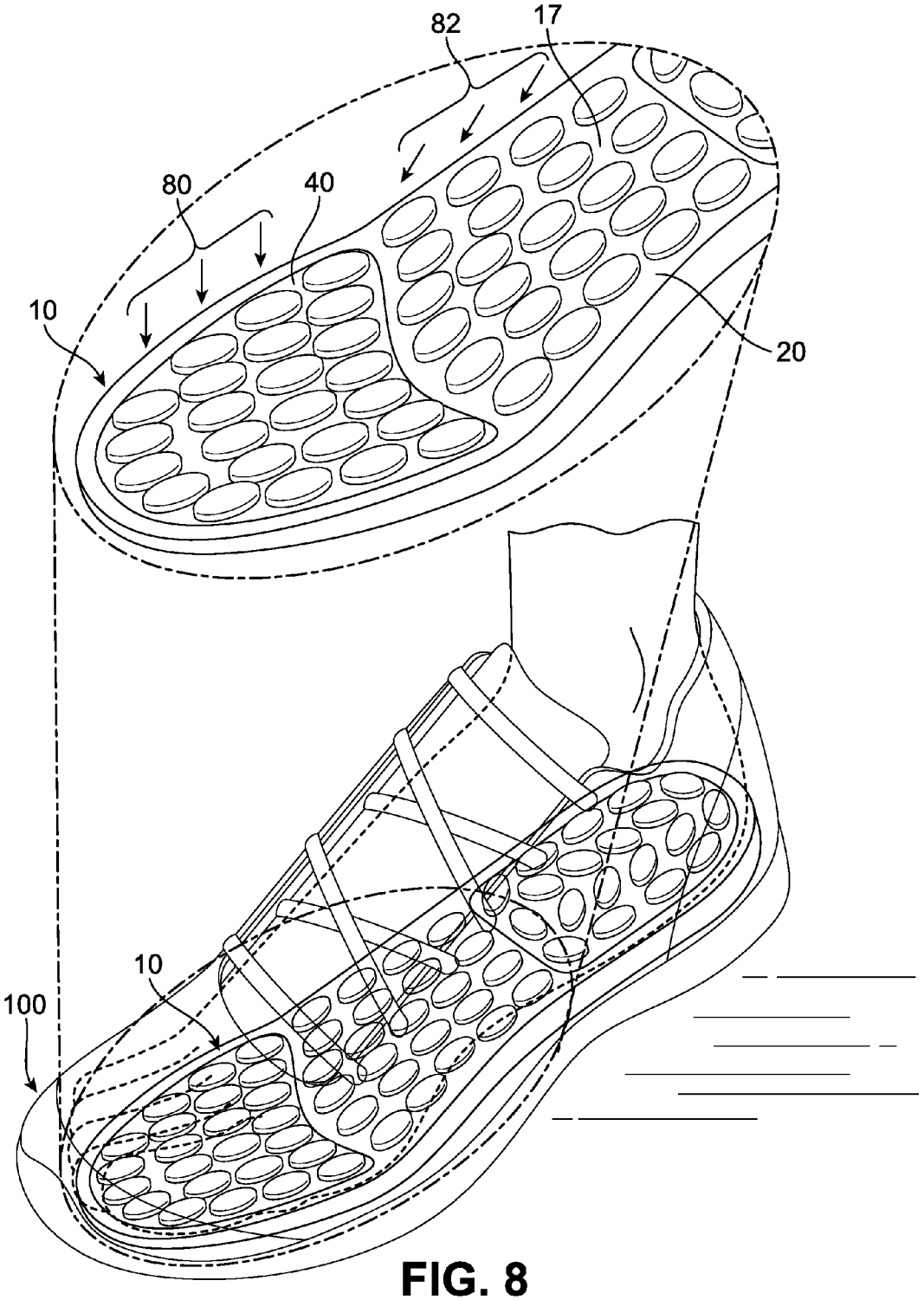
FIG. 8 is a side perspective view of an embodiment of a dual-density insole shown within an article of footwear, as well as some of the forces that may be applied to the insole during motion.

FIG. 8 depicts insole 10 in shoe 100 in a running motion. In particular, FIG. 8 depicts a wearer's forefoot pushing off the ground while running. As depicted in FIG. 8, downward forces 80 and forces 82 may be exerted on the forefoot section of insole 10. In particular, forces 80 and forces 82 are exerted on first insert 40 and on carrier 20 at a midfoot portion 17. Similar forces may be exerted on a heel section of insole 10 when a wearer's heel strikes the ground (not shown). During running, impact forces 80 and forces 82 (as well as those forces produced when the heel strikes the ground, not shown) may be as much as several times the wearer's body weight.

Insole 10 may include provisions to counteract forces 80 and forces 82. For example, in some cases, when subjected to forces 80 and forces 82, first insert 40 and second insert 50 may depress less than carrier 20. In at least one embodiment, where first insert 40 and second insert 50 exhibit a higher hardness level than carrier 20, first insert 40 and second insert 50 may tend to depress less and thereby rebound the wearer's foot more easily. In other cases, however, first insert 40 and second insert 50 may be configured to depress more than carrier 20. For example, in some cases, where first insert 40 and second insert 50 exhibit a lower hardness level than carrier 20, first insert 40 and second insert 50 may tend to depress more and thereby cushion the wearer's foot on impact.

Figure 9:
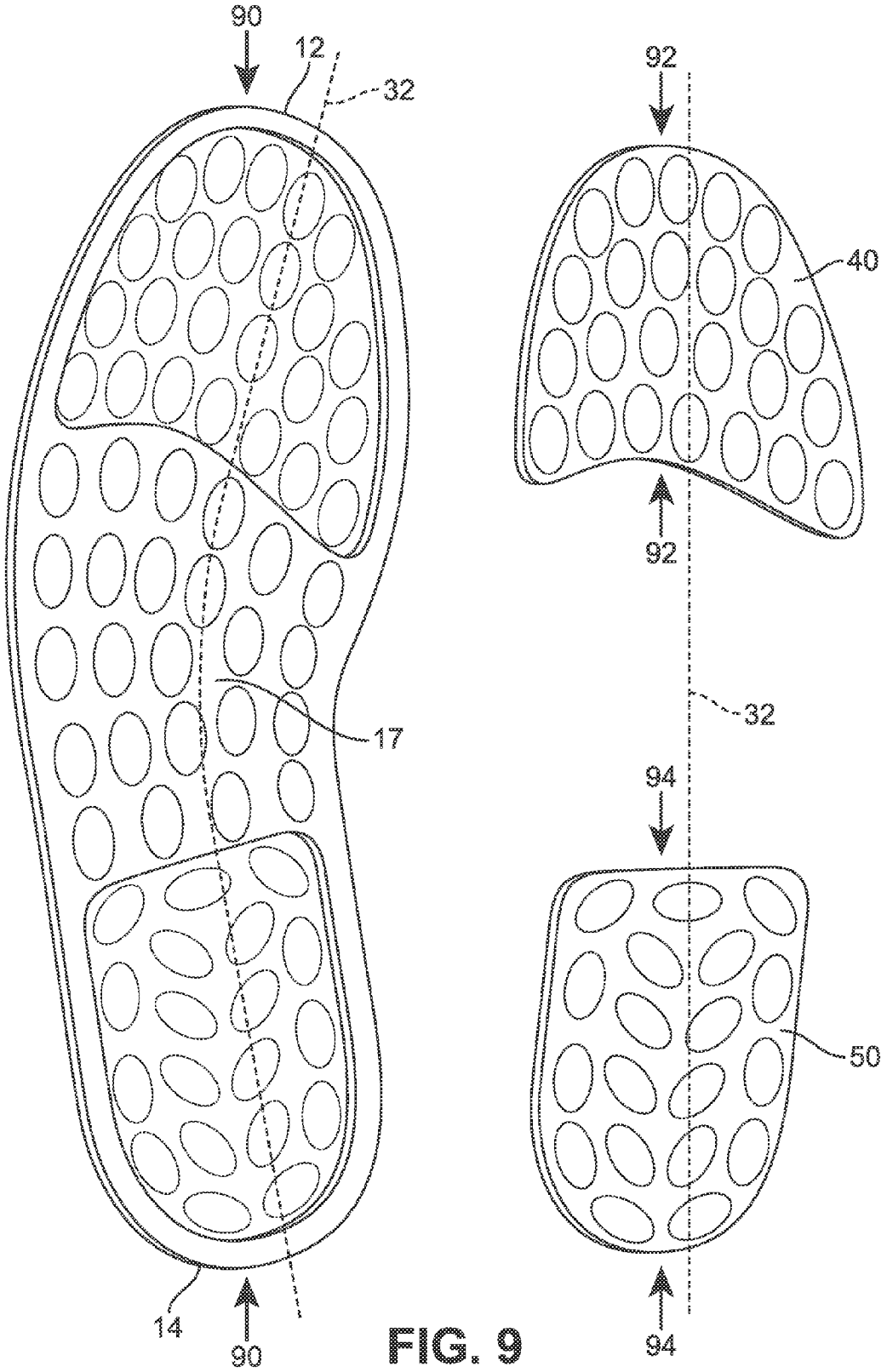
FIG. 9 is a top view of portions of an embodiment of a dual-density insole, wherein deflection of the portions of the insole, in response to an applied force, is shown.
Figure 10:
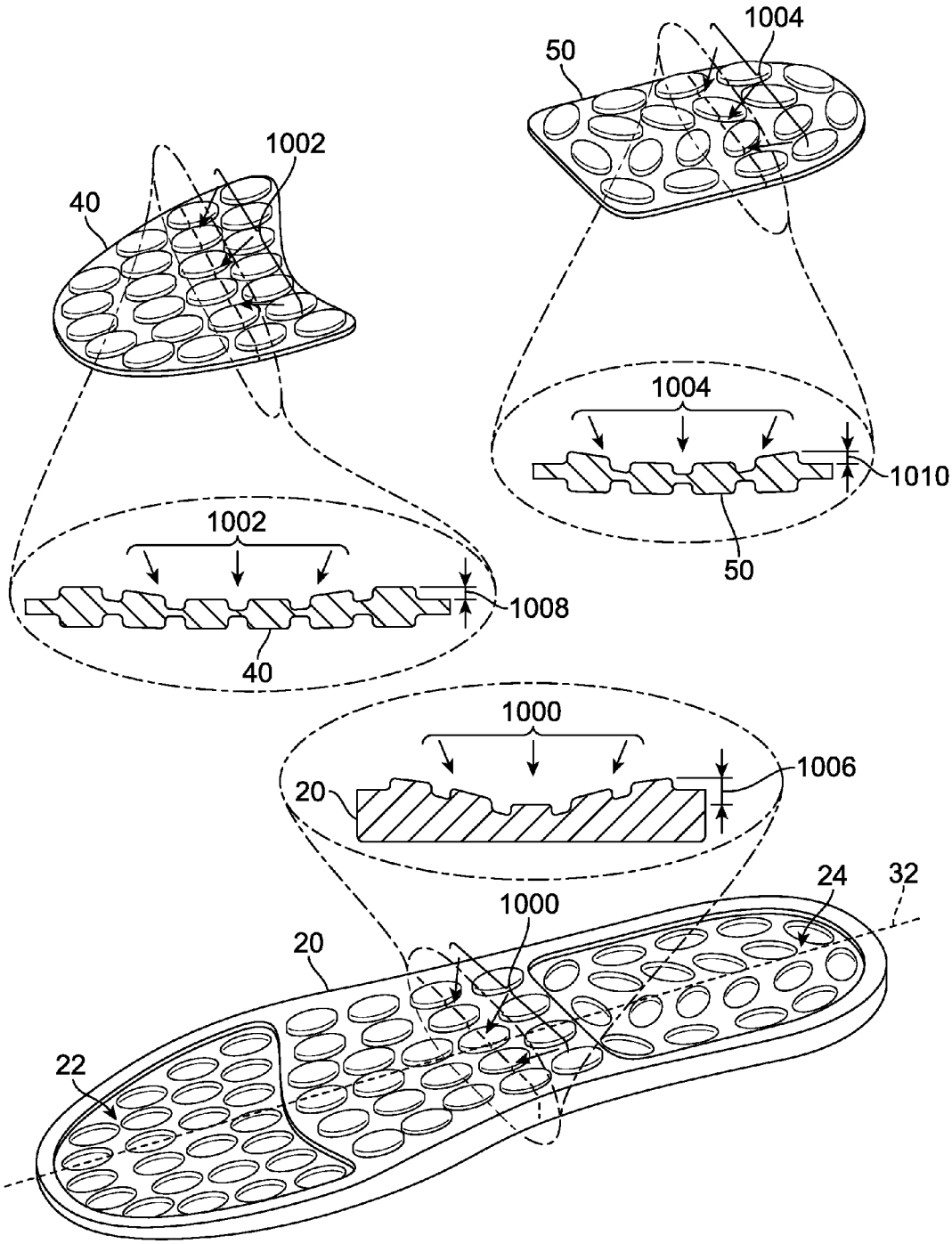
FIG. 10 is a cross-sectional view of portions of an embodiment of a dual-density insole, wherein deflection of the portions of the insole, in response to an applied force, is shown.

FIGS. 9 and 10 depict the relative movement of carrier 20, first insert 40 and second insert 50 in response to an impact force according to at least one embodiment. According to the embodiment of FIGS. 9 and 10, first insert 40 and second insert 50 are comprised of a higher hardness level than carrier 20. As depicted, when subjected to equal forces, first insert 40 and second insert 50 in FIGS. 9 and 10 deform less and rebound more easily.

FIG. 9 depicts carrier 20 being subjected to equal forces 90 at a forefront end 12 and heel end 14. Further, FIG. 9 depicts first insert 40 being subjected to equal forces 92, and second insert 50 is also being subjected to equal forces 94. According to the embodiment depicted in FIGS. 9 and 10, forces 90, forces 92 and forces 94, all forces exerted at the ends of a center line 32, are all equal in magnitude. As may be appreciated from FIG. 9, when subjected to forces 90, carrier 20 collapses and deforms along center line 32. However, when subjected to the same level of force (forces 92 and forces 94), first insert 40 and second insert 50, made of a harder material than carrier 20, deform very little along center line 32.

FIG. 10 also depicts how carrier 20 may deflect more than first insert 40 and second insert 50 when each component is subjected to an equal downward impact force, according to the embodiment. This gradient in the amount of deflection is related to, and in some cases a result of, the gradient in hardness level of the materials of carrier 20, first insert 40 and second insert 50. As may be seen in FIG. 10, carrier 20, first insert 40 and second insert 50 are each being subjected to impact forces 1000, impact forces 1002 and impact forces 1004, respectively. According to the embodiment described herein, forces 1000, forces 1002 and forces 1004, all downward forces, are equal in magnitude. According to the embodiment of FIG. 10, in response to forces 1000, carrier 20 deflects by a distance 1006. In response to forces 1002 and forces 1004, first insert 40 and second insert 50 deflect by distance 1008 and distance 1010, respectively. In some cases, distance 1008 and distance 1010 may be substantially smaller than distance 1006. In other words, in some cases, when comprised of a material with a higher hardness level than carrier 20, first insert 40 and second insert 50 may tend to deflect less than carrier 20 when subjected to downward impact forces. In addition, in some cases, first insert 40 and second insert 50 may also absorb the impact forces more readily. In still other cases, insert 40 and insert 50 may also rebound more readily than carrier 20, providing increased support to the wearer's foot.

While various embodiments have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

What is claimed is:

1. An insole configured for placement in an article of footwear having an upper and a ground-contacting outsole, the insole comprising:

a carrier having a top surface and a bottom surface, wherein the top surface of the carrier includes a first cavity and a second cavity;

a first insert having a top surface and a bottom surface, wherein the first insert is configured to fit within the first cavity, and wherein the bottom surface of the first insert includes a first plurality of lower protrusions configured to mate with a surface of the first cavity; and a second insert having a top surface and a bottom surface, wherein the second insert is configured to fit within the second cavity, and wherein the bottom surface of the second insert includes a second plurality of lower protrusions configured to mate with a surface of the second cavity;

wherein the top surface of the first insert includes a first plurality of upper protrusions and the to surface of the second insert includes a second plurality of upper protrusions;

wherein the surface of the first cavity includes indentations configured to receive the first plurality of lower protrusions on the bottom surface of the first insert such that the surface of the first cavity is configured to mate with the bottom surface of the first insert;

wherein the surface of the second cavity includes indentations configured to receive the second plurality of lower protrusions on the bottom surface of the second insert such that the surface of the second cavity is configured to mate with the bottom surface of the second insert;

wherein the to surface of the carrier includes a third plurality of upper protrusions;

the insole having a forefoot end and a heel end;

wherein the insole is adapted to be placed into a footbed of the article of footwear within the upper of the article of footwear;

wherein the top surface of the first insert, the top surface of the second insert and the top surface of the carrier are adapted to directly contact the foot of a wearer when the insole is placed in an article of footwear; and wherein the protrusions on the top surface of the carrier, the protrusions on the top surface of the first insert, and the protrusions on the top surface of the second insert together substantially cover a top surface of the insole.

2. The insole according to claim 1, wherein the first plurality of lower protrusions on the bottom surface of the first insert are a mirror image of the first plurality of upper protrusions on the top surface of the first insert.

3. The insole according to claim 1, wherein when the first insert is positioned in the first cavity, the top surface of the first insert is generally flush with the top surface of the carrier.

4. The insole according to claim 1, wherein the protrusions on the top surface of the first insert comprise rounded protrusions.

5. The insole according to claim 1, wherein the protrusions on the top surface of the first insert comprise oval-shaped protrusions.

6. The insole according to claim 1, wherein the first plurality of lower protrusions are oval-shaped protrusions and the indentations on the surface of the first cavity configured to receive the first plurality of lower protrusions are oval-shaped indentations.

7. The insole according to claim 5, wherein the oval-shaped protrusions on the top surface of the first insert are generally oriented such that a first end of each oval is positioned towards the forefoot end of the insole and a second end of each oval is positioned towards the heel end of the insole.

8. The insole according to claim 7, wherein the oval-shaped protrusions on the top surface of the first insert have an approximately convex geometry.

9. The insole according to claim 1, wherein the second plurality of upper protrusions on the top surface of the second insert comprise:

an exterior set of oval-shaped protrusions generally oriented in a circumferential pattern around a perimeter of the top surface of the second insert, and wherein the oval-shaped protrusions in the exterior set are positioned end-to-end; and an interior set of oval-shaped protrusions including at least one protrusion group, wherein the at least one protrusion group includes at least two oval-shaped protrusions, and wherein forefoot ends of the at least two oval-shaped protrusions are spaced further apart than heel ends of the at least two oval-shaped protrusions.

10. The insole according to claim 1, wherein the second plurality of upper protrusions on the second insert are oval-shaped and are arranged in an approximately V-shaped configuration.

11. The insole according to claim 1, wherein the third plurality of upper protrusions on the top surface of the carrier are oval-shaped, are positioned on a midsection of the carrier, and are generally oriented such that a first end of each oval is positioned towards the forefoot end and a second end of each oval is positioned towards the heel end of the insole.

12. The insole according to claim 1, wherein the second cavity is at a heel end of the carrier;

wherein the carrier is comprised of a material having a first hardness level;

wherein the first insert is comprised of a material having a second hardness level;

wherein the second insert is comprised of a material having a third hardness level;

wherein the second hardness level and the third hardness level are higher than the first hardness level; and wherein the first insert and the second insert are configured to deflect less than the carrier when each is subjected to an equal downward force.

13. The insole according to claim 12, wherein the carrier includes a midfoot portion separating the first insert and the second insert.

14. The insole according to claim 12, wherein the second plurality of lower protrusions on the bottom surface of the second insert comprises a plurality of rounded protrusions, and wherein the indentations on the surface of the second cavity include a plurality of rounded indentations that are configured to mate with the plurality of rounded protrusions on the bottom surface of the second insert.

15. The insole according to claim 12, wherein the second plurality of upper protrusions are arranged into an interior set of protrusions and an exterior set of protrusions and wherein the interior set of protrusions have a substantially different orientation than the exterior set of protrusions.

16. The insole according to claim 12, wherein the second hardness level is equal to the third hardness level.

17. The insole according to claim 12, wherein the first hardness level is approximately 35 Asker C hardness, the second hardness level is approximately 55 Asker C hardness, and the third hardness level is approximately 55 Asker C hardness.

18. An article of footwear including an upper configured to enclose a foot of a wearer, and a sole, the sole comprising:

a ground-contacting outsole; and an insole configured for placement into a footbed of the article of footwear inside the upper of the article of footwear, the insole having an upper side, a lower side, a forefoot end, and a heel end, the insole including:

a first insert having a top surface and a bottom surface;

a second insert having a top surface and a bottom surface; and a carrier having a top side, a bottom side, a first cavity in the top side of the carrier, and a second cavity in the top side of the carrier, the first cavity being configured to receive the first insert, and the second cavity being configured to receive the second insert;

wherein the top surface of the first insert includes a first plurality of upper protrusions and the to surface of the second insert includes a second plurality of upper protrusions;

wherein the bottom surface of the first insert includes a first plurality of lower protrusions and the bottom surface of the second insert includes a second plurality of lower protrusions;

wherein a surface of the first cavity includes a plurality of indentations configured to receive the first plurality of lower protrusions on the bottom surface of the first insert such that the surface of the first cavity is configured to mate with the bottom surface of the first insert;

wherein a surface of the second cavity includes a plurality of indentations configured to receive the second plurality of lower protrusions on the bottom surface of the second insert such that the surface of the second cavity is configured to mate with the bottom surface of the second insert;

wherein the top side of the carrier includes a third plurality of upper protrusions; and wherein the top surface of the first insert, the to surface of the second insert and the to side of the carrier are adapted to directly contact the foot of a wearer when the insole is placed in the article of footwear.

19. The article of footwear according to claim 18, wherein the first plurality of upper protrusions on the top surface of the first insert are oval-shaped protrusions, each oval-shaped protrusion on the first insert having a length associated with a longitudinal axis running from the forefront end of the insole to the heel end of the insole and a width associated with a lateral direction running perpendicular to the longitudinal axis of the insole, wherein the length of each oval-shaped protrusion on the first insert is longer than the width of each oval-shaped protrusion on the first insert, and wherein each oval-shaped protrusion on the first insert is generally oriented such that a first end of the length of each oval-shaped protrusion is positioned towards the forefoot end of the insole and a second end of the length of each oval-shaped protrusion is positioned towards the heel end of the insole.

20. The article of footwear according to claim 18, wherein the second plurality of upper protrusions on the top surface of the second insert are oval-shaped protrusions and further comprise:

an exterior set of oval-shaped protrusions generally oriented in a circumferential pattern around a perimeter of the top surface of the second insert, and wherein the oval-shaped protrusions in the exterior set are positioned end-to-end; and an interior set of oval-shaped protrusions including at least one protrusion group, wherein the at least one protrusion group includes at least two oval-shaped protrusions, and wherein forefoot ends of the at least two oval-shaped protrusions are spaced further apart than heel ends of the at least two oval-shaped protrusions.

21. The article of footwear according to claim 19, wherein the top side of the carrier has a top surface with the third plurality of upper protrusions; and wherein the third plurality of upper protrusions on the top surface of the carrier are oval-shaped protrusions positioned on a midfoot portion of the carrier, and wherein the oval-shaped protrusions on the midfoot portion of the carrier have generally the same shape and orientation as the first plurality of upper protrusions on the first insert.

22. The article of footwear according to claim 18, wherein:

the bottom surface of the first insert is a mirror image of the top surface of the first insert.

* * * * *